US008193734B2

(12) United States Patent
Chen et al.

(10) Patent No.: US 8,193,734 B2
(45) Date of Patent: Jun. 5, 2012

(54) CONTROL CIRCUIT AND METHOD FOR BACKLIGHT SOURCES, AND IMAGE DISPLAY APPARATUS AND LIGHTING APPARATUS USING THE SAME

(75) Inventors: Po-Yen Chen, Taipei (TW); Yeu-Torng Yau, Tainan (TW); Hung-Chun Li, Taoyuan County (TW); Li-Ling Lee, Hsinchu County (TW); Ming-Che Yang, Taichung County (TW)

(73) Assignee: Industrial Technology Research Institute, Hsinchu (TW)

( * ) Notice: Subject to any disclaimer, the term of this patent is extended or adjusted under 35 U.S.C. 154(b) by 575 days.

(21) Appl. No.: 12/490,567

(22) Filed: Jun. 24, 2009

(65) Prior Publication Data

US 2010/0102752 A1 Apr. 29, 2010

(30) Foreign Application Priority Data

Oct. 28, 2008 (TW) ..... 97141439 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/00* | (2006.01) |
| *G09G 3/32* | (2006.01) |
| *G09G 3/36* | (2006.01) |

(52) U.S. Cl. ..... 315/294; 315/299; 315/312; 345/82; 345/87; 345/102

(58) Field of Classification Search ..... None
See application file for complete search history.

(56) References Cited

U.S. PATENT DOCUMENTS 8,110,995 B2 * 2/2012 Deurenberg ..... 315/152

OTHER PUBLICATIONS

"LED Backlight Driving System for Large-Scale LCD Panels" Huang-Jen Chiu et al.; IEEE Transactions of Industrial Electronics, vol. 54, No. 5, Oct. 2007.

"Current Controlled X-Y Channel Driving White LED Backlight System for 46 LCD TV" Daeyoun Cho et al.; IMID(International Meeting on Information Display), Ilsan, Korea, 2008.

"A Novel Two-Dimensional Adaptive Dimming Technique with X-Y Channels for LED Backlight System of LCD TVs" Won-Sik Oh et al.; Journal of Display Technology, vol. 5, Issue 1, Jan. 2009.

* cited by examiner

*Primary Examiner* — Douglas W Owens
*Assistant Examiner* — Dedei K Hammond
(74) *Attorney, Agent, or Firm* — Thomas|Kayden

(57) ABSTRACT

An light emitting diode (LED) control, a plurality of duty cycle signals corresponding to a plurality of LEDs are stored in a dual-port memory by memory mapping. By sampling, the stored duty cycle signals are outputted to generate a plurality of parallel single-bit data each having one single bit. After the single-bit data are converted by a data transmission module, each bit of the single-bit data is serially outputted to a drive module to drive the LEDs. Thus, the ON duty cycles of the LEDs are modulated by pulse width modulation (PWM), light emitted from the LEDs are mixed in time-domain, and the brightness of the LEDs can be controlled.

25 Claims, 5 Drawing Sheets

CONTROL CIRCUIT AND METHOD FOR BACKLIGHT SOURCES, AND IMAGE DISPLAY APPARATUS AND LIGHTING APPARATUS USING THE SAME

This application claims the benefit of Taiwan application Serial No. 97141439, filed Oct. 28, 2008, the subject matter of which is incorporated herein by reference.

TECHNICAL FIELD

The application relates in general to a fully digital light source control circuit, and more particularly to a fully digital light source control circuit used in the control of LED light source.

BACKGROUND

Liquid crystal TV (LCD TV) and liquid crystal display (all referred as LCD display devices here below), having the advantages of lightweight, small volume, low radiation, low power consumption, have become mainstream products in the market. Moreover, consumers are expecting large-sized and high-resolution LCD display devices.

Compared with the conventional cathode ray tube TV (CRT TV), the LCD display device has inferior performance in terms of contrast and color saturation. However, these disadvantages can be compensated by a superior backlight source.

Currently, the backlight source of LCD display devices is mainly classified as cold cathode fluorescent lamp (CCFL) and light emitting diode (LED).

Despite the CCFL has many advantages such as emission of excellent white light, low cost, high efficiency, long lifespan, good stability, and convenient operation, the CCFL has its disadvantages. For example, the products using CCFL are not environmental friendly (because mercury is contained), the color saturation is not enough (can reach only 70%~80% of color saturation), and for the large-sized screen using CCFL, the working voltage is too high and the tube is too long.

In comparison, the LED has the following advantages such as low power consumption, long lifespan, small volume, light weight, and being environmental friendly. The color saturation of the LED can reach almost 100%. Drive time for the CCFL is about 1 sec~2 sec, but the drive time for the LED are about 50 ns.

The LED backlight source can be classified as white light LED and RGB LED. By using color-filterless technology, the three color light emitted by the RGB LED is mixed in time-domain to produce white light. The white light LED has lower cost, but the RGB LED has superior color characteristics. When the RGB LED is used as the backlight source of the LCD display device, the contrast can reach the ratio of 50000:1.

FIG. 1 shows a first generally known LED driving architecture. Backlight unit 100 includes several LED modules 110 and LED drivers 120. Each LED module 110 includes a red light LED array 111, a green light LED array 112, and a blue light LED array 113. The red light LED array 111 has several serially connected red light LEDs. The green light LED array 112 has several serially connected green light LEDs. The blue light LED array 113 has several serially connected blue light LEDs. The LED driver 120 includes a red LED drive circuit 121 for driving the red light LED of an LED module, a green LED drive circuit 122 for driving the green light LED of an LED module, and a blue LED drive circuit 123 for driving the blue light LED of an LED module.

According to the first generally known technology, if the performance of brightness/color is not good in a particular LED, then the brightness/color of the LED array would also be negatively affected, causing the LED arrays to have different performance in terms of brightness/color.

FIG. 2 shows a second generally known LED driving architecture. The LED driving architecture includes a switching mode power supply (SMPS) 21, a bridge board 22, light source 23, a sensor 24 and a microcontroller 25.

The SMPS 21 includes an AC-to-DC converter 211 for converting an external AC voltage to a DC voltage. The red light (R) LED DC-to-DC converter 212 is for converting a DC voltage converted by the AC-to-DC converter 211 into a DC voltage applicable for driving the red light LED. The green light (G) LED DC-to-DC converter 213 is for converting a DC voltage converted by the AC-to-DC converter 211 into a DC voltage applicable for driving the green light LED. The blue light (B) LED DC-to-DC converter 214 is for converting a DC voltage converted by the AC-to-DC converter 211 into a DC voltage applicable for driving the blue light LED.

The bridge board 22 electrically connects the DC-to-DC converters 212~214 to the red light, green light and blue light LED fixed current controllers 233~235.

The light source 23 includes a substrate 231, several LEDs 232, and several red light, green light and blue light LED fixed current controllers 233~235. The substrate 231 has several areas 231*a*~231*d*. On each area are red light, green light and blue light LED fixed current controllers 233~235, a red light LED array, a green light LED array and a blue light LED array.

The red light, green light and blue light LED fixed current controllers 233~235 are used for applying a fixed current to the LEDs 232.

The sensor 24 is for detecting light emitted by the light source 23. The microcontroller 25 controls the red light, green light and blue light LED fixed current controllers 233~235 according to the detection result of the sensor 24.

The disadvantages of the second generally known technology are similar to that of first generally known technology. That is, if the performance of brightness/color is not good in a particular LED, then the brightness/color of the LED array would also be negatively affected, causing the LED arrays to have different performance in terms of brightness/color.

Therefore, it needs an architecture for controlling the LED light source, which individually controls the brightness and color of each LED and is applicable to the image display apparatus such as LCD TV and LCD display.

Besides, the LED can also be used in daily life purposes such as illumination and traffic signs. Thus, the invention also provides an LED driving architecture, which independently controls the brightness and color of each LED.

BRIEF SUMMARY

Embodiment of the application is directed to an LED control circuit, which simplifies the access of data by way of memory mapping. Besides, the format of data is converted, so the number of the I/O pins of the circuit is reduced, and the manufacturing cost is reduced accordingly. The LED control circuit has independent control on the brightness of each LED.

An exemplary embodiment of the present application is directed to an image display apparatus. The image display apparatus has independent control of the brightness of each LED, hence achieving an image display with high contrast and high color saturation.

Still another exemplary embodiment of the present application is directed to a lighting apparatus. The lighting apparatus has independent control of the brightness of each LED, and is thus capable of controlling the color and the brightness of the light emitted by the lighting apparatus.

According to an example of the present invention, an LED control circuit is provided. The LED control circuit is used in an image display apparatus or a lighting apparatus, having a drive module and a plurality of LEDs. The LED control circuit includes a memory, a memory control unit, a modulation unit, and a data transmission module. The memory stores a plurality of duty cycle signals by way of memory mapping, wherein each duty cycle signal is related to each LED. The memory control unit is coupled to the memory used for accessing the duty cycle signals stored in the memory. The modulation unit is coupled to the memory control unit for modulating the duty cycle signals accessed by the memory control unit into a plurality of first digital data, wherein the first digital data are for indicating the ON/OFF state of LEDs. The data transmission module is coupled to the modulation unit for receiving the first digital data in parallel. The data transmission module converts the first digital data and serially outputs a plurality of second digital data. The drive module receives the second digital data to control the ON/OFF state of LEDs.

According to another example of the present invention, an image display apparatus is provided. The image display apparatus includes a panel, a plurality of LEDs for illuminating the panel, a drive module for driving the LEDs, and an LED control circuit. The LED control circuit includes a memory, a memory control unit, a modulation unit, and a data transmission module. The memory stores a plurality of duty cycle signals by memory mapping, wherein each duty cycle signal is related to each LED. The memory control unit is coupled to the memory, for accessing the duty cycle signals stored in the memory. The modulation unit is coupled to the memory control unit, for modulating the duty cycle signals accessed by the memory control unit into a plurality of first digital data, wherein the first digital data are for indicating the ON/OFF state of LEDs. The data transmission module is coupled to the modulation unit, for receiving the first digital data in parallel, wherein after the first digital data are converted by the data transmission module, a plurality of second digital data are serially outputted. The drive module receives the second digital data to control the ON/OFF state of LEDs.

According to still another example of the present invention, a lighting apparatus is provided. The lighting apparatus includes a plurality of LEDs for emitting light, a drive module for driving the LEDs, and an LED control circuit. The LED control circuit includes a memory, a memory control unit, a modulation unit, and a data transmission module. The memory stores a plurality of duty cycle signals by memory mapping, wherein each duty cycle signal is related to each LED. The memory control unit is coupled to the memory, for accessing the duty cycle signals stored in the memory. The modulation unit is coupled to the memory control unit, for modulating the duty cycle signals accessed by the memory control unit into a plurality of first digital data, wherein the first digital data are for indicating the ON/OFF state of LEDs. The data transmission module is coupled to the modulation unit, for receiving the first digital data in parallel, wherein after the first digital data are converted by the data transmission module, a plurality of second digital data are serially outputted. The drive module receives the second digital data to control the ON/OFF state of LEDs.

According to yet another example of the present invention, a method for controlling a plurality of LEDs is provided. The control method includes the following steps of: serially receiving and temporarily storing a plurality of duty cycle signals; modulating the duty cycle signals to generate a plurality of parallel first digital data, wherein the first digital data are for indicating the ON/OFF state of LEDs; converting the parallel first digital data into a plurality of second digital data and serially outputting the second digital data; and driving the LEDs according to the second digital data to control light mixture in time-domain and the brightness of the LEDs.

It is to be understood that both the foregoing general description and the following detailed description are exemplary and explanatory only and are not restrictive of the disclosed embodiments, as claimed.

DETAILED DESCRIPTION OF EXEMPLARY EMBODIMENT OF THE INVENTION

In embodiments of the invention, the access of data is simplified by way of memory mapping. Besides, the data format is converted, so the number of the I/O pins of the circuit is reduced, and the manufacturing cost is reduced accordingly. Besides, the embodiments of the invention have independent control on brightness of each LED, hence achieving an image display with high contrast and high color saturation.

Figure 1:
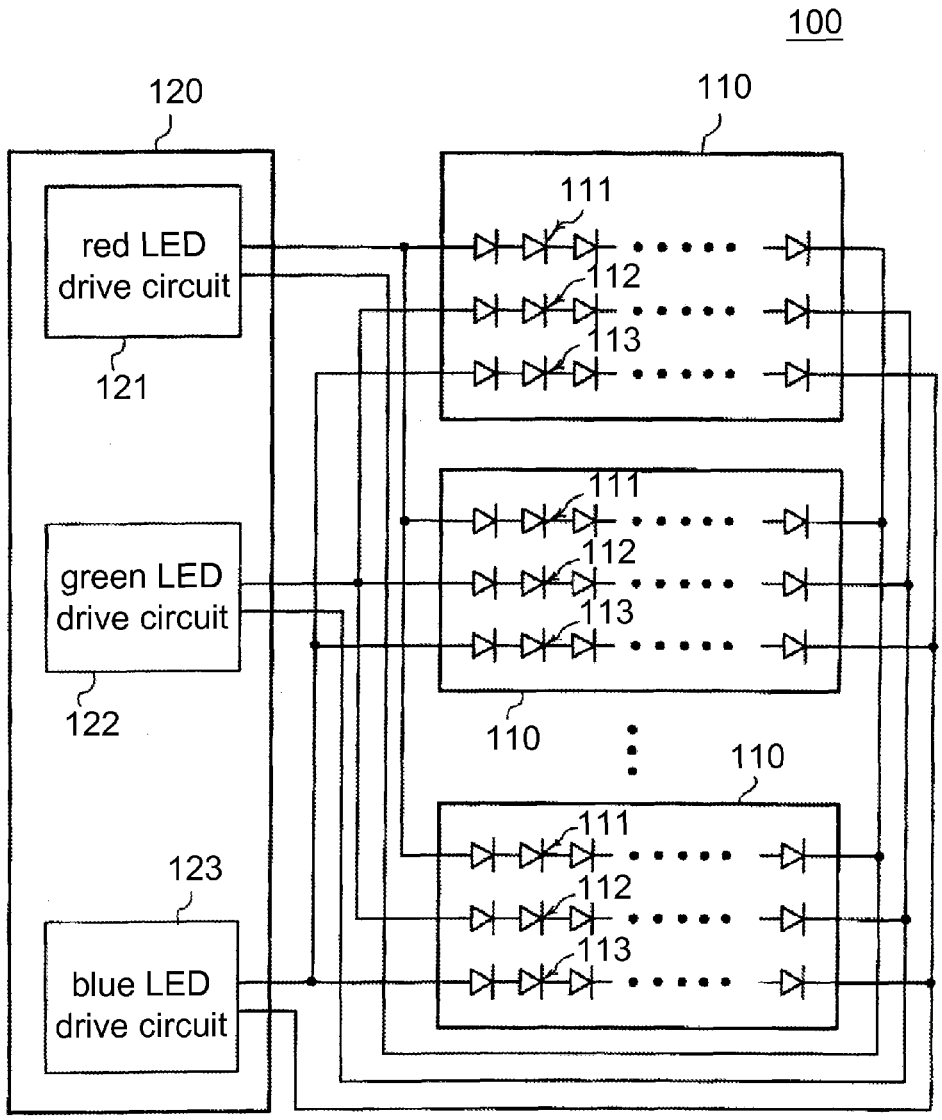
FIG. 1(PRIOR ART)
FIG. 1 (Prior Art) is a first generally known LED driving architecture.
Figure 2:
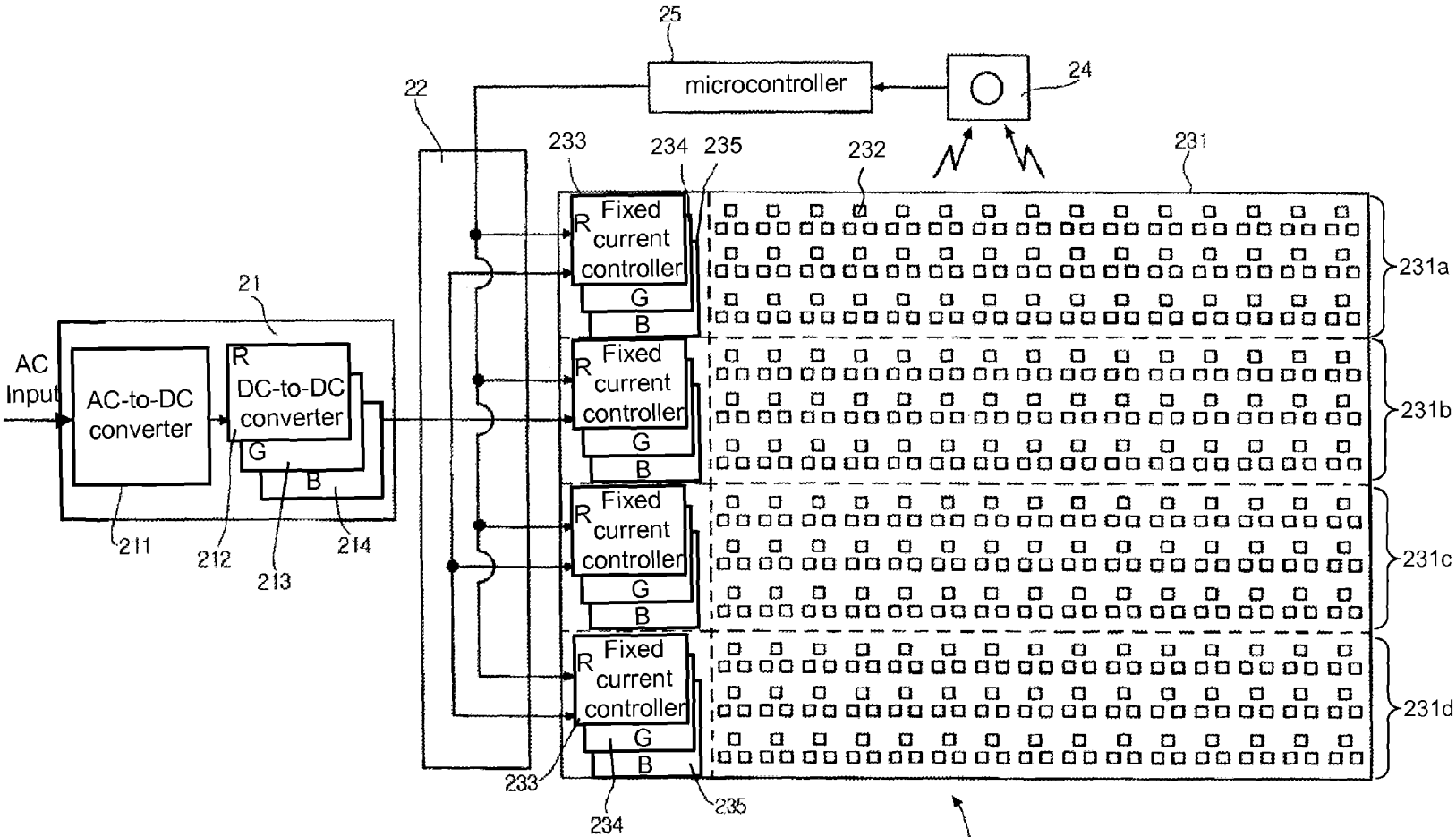
FIG. 2(PRIOR ART)
FIG. 2 (Prior Art) is a second generally known LED driving architecture.
Figure 3:
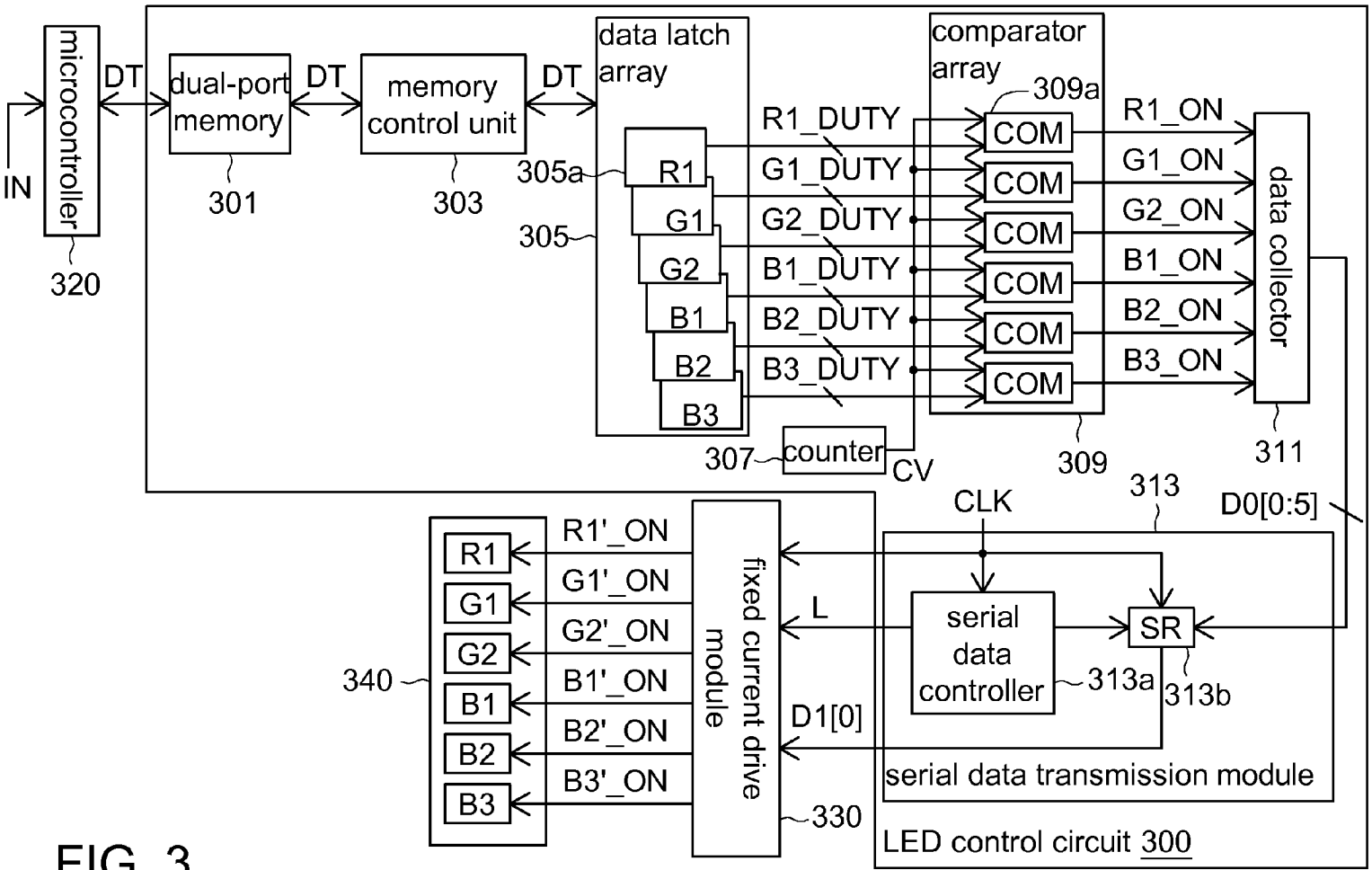
FIG. 3 is an LED control circuit according to an embodiment of the invention.

An embodiment of the invention provides an LED control circuit used in an image display apparatus or a lighting apparatus having a drive module and a plurality of LEDs. FIG. 3 shows an LED control circuit according to an embodiment of the invention. In the embodiment of the invention, the drive module is a fixed current drive module 330, the LEDs constitute an LED array 340, and the LED control circuit 300 controls each LED of the LED array 340 for light mixture. For convenience of elaboration, the LED array 340 below includes one red light LED R1, two green light LEDs G1~G2, and three blue light LEDs B1~B3. Anyone who is skilled in the technology will understand that the invention is not limited to the above exemplifications, and the LED control circuit 300 may control more color light LEDs. Furthermore, the LED control circuit 300 may control other color LED (for example white LED). Besides, the number and the ratio of the color light LEDs can be adjusted according to actual needs and are still within the spirit and scope of the invention.

For simplification, the LED control circuit at least includes a memory, a memory control unit, a modulation unit and a data transmission module.

Referring to FIG. 3, in the present embodiment of the invention, the memory is a dual-port memory 301, which stores a plurality of duty cycle signals DT by way of memory mapping, wherein each duty cycle signal DT is related to each LED of the LED array 340. The LED array 340 includes one LED R1, two LEDs G1~G2, and three LEDs B1~B3.

The memory control unit 303 is coupled to the dual-port memory 301, for accessing the duty cycle signals DT stored in the dual-port memory 301.

The modulation unit is coupled to the memory control unit 303, for modulating the duty cycle signals DT accessed by the memory control unit 303 into a plurality of first digital data R1_ON~B3_ON. The first digital data R1_ON~B3_ON are for indicating the ON/OFF state of LEDs. In the present embodiment of the invention, the modulation unit includes a counter 307 and a comparator array 309. The counter 307 is for generating a counting value CV. The comparator array 309 includes a plurality of comparators 309*a*, each comparing the counting value CV with each corresponding duty cycle signals R1_DUTY~B3_DUTY to generate the first digital data R1_ON~B3_ON.

The data transmission module is coupled to the modulation unit, for receiving the first digital data R1_ON~B3_ON in parallel, and for converting the first digital data R1_ON~B3_ON to serially output a second digital data D1. In the present embodiment of the invention, the data transmission module includes a data collector 311 and a serial data transmission module 313. The data collector 311 receives the first digital data R1_ON~B3_ON outputted from the modulation unit and arranges them as a third digital data D0, wherein the first digital data R1_ON~B3_ON all include one single bit, and the third digital data D0 includes a plurality of bits. The serial data transmission module 313 is coupled to the data collector 311, for serially outputting the third digital data D0 as the second digital data D1, wherein the second digital data D1 includes one single bit. Besides, in the present embodiment of the invention, the serial data transmission module 313 further includes a shift register (SR) 313*b* and a serial data controller 313*a*. The shift register 313*b*, which temporarily stores the third digital data D0, serially outputs each bit of the third digital data D0 bit by bit as the second digital data D1. The data controller 313*a* controls the shift register 313*b* and outputs a latch signal L to the fixed current drive module 330 to inform the completion of data transmission.

The fixed current drive module 330 receives the second digital data D1 to control the ON/OFF state of LEDs LED R1, LED G1~G2, LED B1~B3.

In the present embodiment of the invention, the LED control circuit 300 further includes a data latch array 305 coupled to the memory control unit 303 for temporarily storing the duty cycle signals DT accessed by the memory control unit 303 and for respectively outputting the duty cycle signals R1_DUTY~B3_DUTY to the modulation unit. The data latch array 305 includes a plurality of data latches 305*a* temporarily storing the duty cycle signals DT respectively. It is noted that the dual-port memory 301 serially receives the duty cycle signals DT.

Thus, in the present embodiment of the invention, the LED control circuit 300 includes a dual-port memory 301, a memory control unit 303, a data latch array 305, a counter 307, a comparator array 309, a data collector 311, and a serial data transmission module 313. The data latch array 305 includes a plurality of data latches 305*a*. The comparator array 309 includes a plurality of comparators 309*a*. The serial data transmission module 313 includes a serial data controller 313*a* and a shift register 313*b*. The counter 307 and the comparator array 309 constitute a modulation unit. The data collector 311 and the serial data transmission module 313 constitute a data transmission module.

The operations of the embodiment of the invention are exemplified below. The microcontroller 320 receives a frame data IN and generates the corresponding duty cycle signal DT of each LED accordingly. In the present embodiment, the duty cycle signal DT has 8 bits. The microcontroller 320 generates 6 duty cycle signals DT, each respectively corresponding to one red light LED R1, two green light LEDs G1~G2, and three blue light LED B1~B3. The duty cycle signal DT denotes the turn-on time ratio of the LED in a duty cycle. In other words, the duty cycle signal DT denotes the brightness of the LED. For example, if the brightness of the LED R1 is 50%, then its corresponding duty cycle signal DT is 127 (1000000). Likewise, suppose the brightness of LED G1 is 100%, then its corresponding duty cycle signal DT is 255 (11111111).

The duty cycle signals DT outputted from the microcontroller 320 are stored in the dual-port memory 301. The dual-port memory 301 has two address ports for receiving two addresses, wherein one address is used for data transmission between the dual-port memory 301 and the microcontroller 320, and the other address is used for data transmission between the dual-port memory 301 and memory control unit 303. Besides, the dual-port memory 301 has two data I/O ports for receiving and outputting data. Therefore, the dual-port memory 301 can process data writing and data reading at the same time. The data transmission between the dual-port memory 301 and the microcontroller 320 is serial. That is, the dual-port memory 301 receives one duty cycle signal DT at a time.

Besides, in the present embodiment of the invention, the data read/write mode of the dual-port memory 301 is a memory mapping mode. The memory mapping mode means each data will be stored in its own fixed storage space of the dual-port memory 301. That is, the duty cycle signal DT corresponding to the LED G1 will be stored in its own fixed storage space of the dual-port memory 301, and the corresponding duty cycle signal DT of the LED G2 will be stored in other its own fixed storage space of the dual-port memory 301. In the present embodiment of the invention, the memory mapping mode simplifies data access of the dual-port memory 301.

Furthermore, if one of the LEDs has color shift, the corresponding duty cycle signal of the color-shifted LED is added by an adjustment value to adjust (increase or decrease) the turn-on time of the LED so as to mitigate the color shift. The adjustment value can be stored in a corresponding storage space of the LED in the dual-port memory beforehand. For example, the duty cycle signal DT outputted from the microcontroller 320 is 125, and after adjustment, the corresponding duty cycle signal DT outputted from the dual-port memory 301 is 135 (suppose the adjustment value is +10). As the duty cycle signal DT is prolonged, the brightness of the LED will be increased, and the color shift will be reduced as well.

The memory control unit 303 accesses the duty cycle signal DT stored in the dual-port memory 301 and then outputs the duty cycle signal DT to a corresponding data latch 305*a* in the data latch array 305. In an example, the dual-port memory 301 outputs one duty cycle signal DT to the memory control unit 303 at a time. Or, in another example, the dual-port memory 301 outputs all duty cycle signals DT to the memory control unit 303 concurrently. The memory control unit 303 can change the input address, to access the duty cycle signals DT related to different LEDs so as to switch the control on each LED.

The data latch array 305 has several data latches 305*a*, each temporarily storing the corresponding duty cycle signal DT related to each LED. For convenience of elaboration, the duty cycle signals DT outputted by the data latches 305*a* are designated as R1_DUTY, G1_DUTY, G2_DUTY, B1_DUTY, B2_DUTY, B3_DUTY, which respectively correspond to the LEDs R1, G1~G2 and B1~B3.

The counter 307 outputs a counter signal CV ranging between 0~255 for example. The counter signal CV outputted from the counter 307 will be outputted to the comparator array 309.

Each comparator 309*a* of the comparator array 309 compares the duty cycle signal with the counter signal CV, and first digital data R1~ON~B3_ON will be generated after comparison. For example, after the comparator 309*a* compares the duty cycle signals R1_DUTY with the counter signal CV, a first digital data R1_ON will be generated. If the duty cycle signal is larger than or equal to the counter signal CV, then the logic value of the first digital data is 1; and if the duty cycle signal is smaller than counter signal CV, then the logic value of the first digital data is 0. Or, if the duty cycle signal is smaller than counter signal CV, then the logic value of the first digital data is 1; and if the duty cycle signal is larger than or equal to counter signal CV, then the logic value of the first digital data is 0.

If the logic value of the first digital data is 1, then the LED emits light (turned ON). To the contrary, if the logic value of the first digital data is 0, then the LED does not emit light (turned OFF). Each of the first digital data R1_ON~B3_ON has one single bit. A plurality of first digital data R1_ON~B3_ON generated from the comparator array 309 will be outputted to the data collector 311.

The counter 307 and the comparator array 309 together are called a "pulse width modulation (PWM) unit", and the first digital data R1_ON~B3_ON outputted thereby can be regarded as PWM signals. In the embodiments of the invention, the first digital data R1_ON is used for driving one LED R1, but anyone who is skilled in the technology will understand that, the first digital data R1_ON can also be used for driving multiple LEDs, which is still within the spirit and scope of the invention.

The data collector 311 parallelly receives first digital data R1_ON~B3_ON (each having one single bit), and generates a third digital data D0[0:5] having 6 bits. The 6-bit third digital data D0[0:5] are constituted by the first digital data R1_ON~B3_ON. For example, if the first digital data R1_ON~B3_ON respectively are 0, 1, 1, 0, 0, 1, then the 6-bit third digital data D0[0:5] are 011001. The way by which the data collector 311 generates the 6-bit third digital data D0[0:5] is not limited to the above exemplification.

The serial data transmission module 313 further converts the third digital data D0[0:5] generated by the data collector 311 into a plurality of second digital data D1[0] each having one single bit, and serially transmits the second digital data D1[0] to the fixed current drive module 330. The serial data transmission module 313 includes a serial data controller 313*a* and a shift register 313*b*. The serial data controller 313*a*, the shift register 313*b* and fixed current drive module 330 receive a serial clock CLK for synchronizing their operations. The shift register 313*b* temporarily stores the third digital data D0[0:5] generated by the data collector 311. Under the control of the serial data controller 313*a*, the shift register 313*b* serially outputs a plurality of second digital data D1[0]. For example, if the third digital data D0[0:5] are 011001, then the second digital data D1[0] serially outputted by the shift register 313*b* are sequentially 0, 1, 1, 0, 0, 1.

If all data in the shift register 313*b* are already outputted, then the serial data controller 313*a* outputs a latch signal L to the fixed current drive module 330. In responding to the latch signal L, the fixed current drive module 330 will, according to the received second digital data D1[0], control the current outputted to the LED array 340 to control the ON/OFF state and the brightness of the LED. In the present embodiment of the invention, the fixed current drive module 330 will serially convert a plurality of serially received second digital data D1[0] into a plurality of fourth digital data R1'_ON~B3'_ON, and output the fourth digital data R1'_ON~B3'_ON in parallel to respectively control the LEDs R1~B3 of the LED array 340.

The output pins of the fixed current drive module 330 respectively correspond to the LEDs of the LED array 340. For example, one output pin of the fixed current drive module 330 is connected to one LED. Furthermore, one output pin of the fixed current drive module 330 can be connected to multiple LEDs. The fixed current drive module 330 can be a multi-channel fixed current drive IC, an analog amplifier or a switch type power supplier. The fixed current drive module 330 has fast response. Besides, the fixed current drive module 330 has a serial transmission interface for serially receiving the data.

Under the control of the LED control circuit 300 and the driving of the fixed current drive module 330, the LED array 340 can mix light in time-domain.

The dual-port memory 301, the memory control unit 303, the data latch array 305, counter 307 and the comparator array 309 convert the serial data (DT) outputted by the microcontroller 320 into a plurality of parallel first digital data (R1_ON~G3_ON). Besides, the data collector 311 and the serial data transmission module 313 convert the parallel first digital data (R1_ON~B3_ON) into a plurality of serial second digital data (D1[0]). Due to the data format conversion, the LED control circuit 300 according to the present embodiment of the invention does not need a large number of I/O pins, so the manufacturing process is simplified and the manufacturing cost is reduced.

The present embodiment of the invention adopts the color-filterless technology to mix light in time-domain. As there is no any color filter which blocks light and negatively affects light utilization, the light utilization rate of LED is largely increased, and the cost for color filter is also saved.

In the present embodiment of the invention, each LED can be steadily controlled, so the slew rate of LED current is lower.

In the present embodiment of the invention, the working current of each LED is controllable, so the LED has better lighting efficiency.

The present embodiment of the invention implements dynamic backlight control, by fast adjusting the light-mixing effect of LED based on the duty cycle signal DT outputted from the microcontroller 320.

The present embodiment of the invention can expand the control for the LED control circuit 300, and the number of data latches 305*a* and comparators 309*a* can be increased to control more LEDs.

The present embodiment of the invention can control the ratio of the red light, the green light and the blue light emitted by the LED backlight source, so the contrast and the color saturation of display image can also be controlled.

The present embodiment of the invention is capable of performing fast and parallel operation, so that the ON/OFF state of LEDs can be switched instantly. Thus, the present embodiment of the invention has high refresh rate, and is conformed to the requirements of high quality image.

The present embodiment of the invention has excellent color compensation because the light brightness of each color light LED can be adjusted respectively. Thus, the present embodiment of the invention achieves high contrast and high color saturation, and is conformed to the requirements of high quality image.

Figure 4:
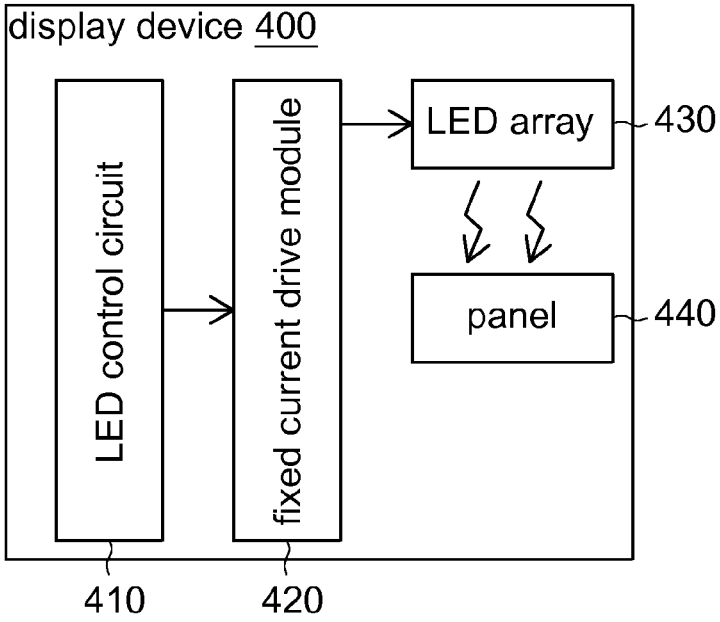
FIG. 4 is a display device according to another embodiment of the invention.

FIG. 4 shows a display device according to another embodiment of the invention. The display device 400, such as but not limited to LCD TV and liquid crystal display, needs a backlight source. As indicated in FIG. 4, the display device 400 includes an LED control circuit 410, a fixed current drive module 420, an LED array 430 and a panel 440. The LED array 430 can be used as a backlight source. The LED control circuit 410 may be the same or similar to the LED control circuit 300 of FIG. 3. The structure and operation of the LED control circuit 410 are not repeated here again.

When dynamic backlight control is performed, the frame data are divided into a plurality of areas according to the distribution of LEDs. Next, the light-mixing ratio and the brightness of LEDs are adjusted according to the color distribution features and the contrast requirement of the frame data. Thus, power consumption is reduced and the frame contrast and color saturation of the display device 400 are effectively improved. Besides, the display device 400 further selectively includes a microcontroller such as the microcontroller 320 of FIG. 3 for example.

Figure 5:
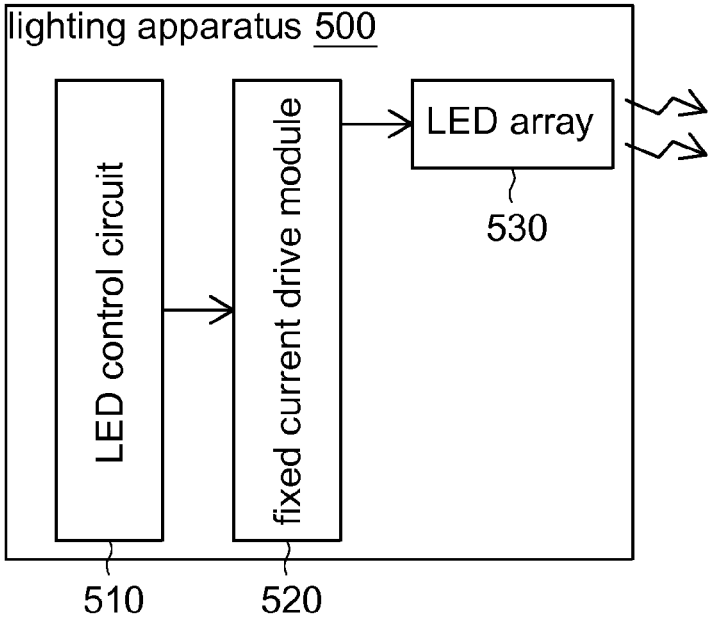
FIG. 5 is a lighting apparatus according to still another embodiment of the invention.

FIG. 5 shows a lighting apparatus according to still another embodiment of the invention. The lighting apparatus 500 emits a light for illumination. The lighting apparatus 500 is exemplified by traffic signs but is not limited thereto. As indicated in FIG. 5, the lighting apparatus 500 includes an LED control circuit 510, a fixed current drive module 520 and an LED array 530. The LED control circuit 510 may be same or similar to the LED control circuit 300 of FIG. 3. The structure and operation of the LED control circuit 510 are not repeated here again.

In the application of FIG. 5, if the duty cycle of each color light LED of the LED array 530 is stored in the dual-port memory beforehand, then the lighting apparatus 500 may not need signal sources or microcontrollers. The duty cycles stored in the dual-port memory can be amended according to actual needs so as to change color light emitted by the lighting apparatus 500. Besides, the lighting apparatus 500 further selectively includes a microcontroller such as the microcontroller 320 of FIG. 3 for example.

Figure 6A:
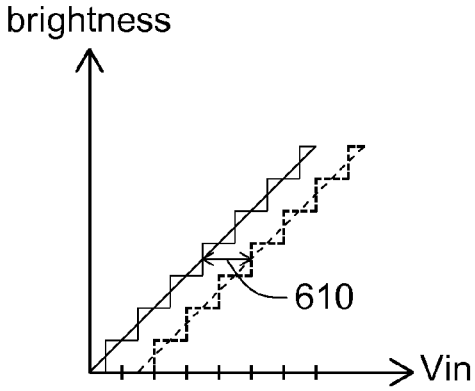
FIG. 6A is a diagram of offset error.
Figure 6B:
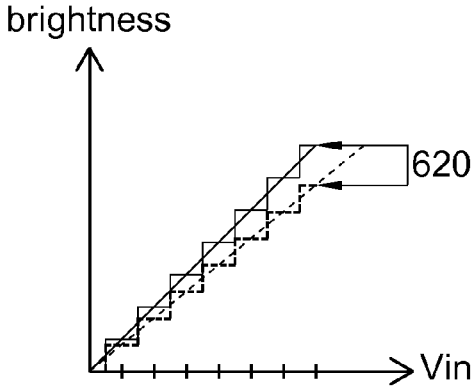
FIG. 6B is a diagram of gain error.
Figure 6C:
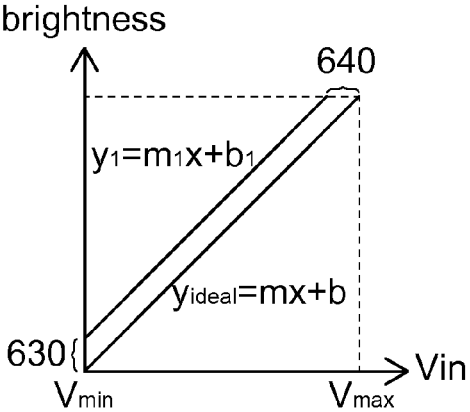
FIG. 6C is a diagram of LED brightness compensation according to embodiments of the invention.

Furthermore, in the embodiments of the invention, the brightness of LEDs can further be compensated. The compensation is performed by the microcontroller 320 of FIG. 3 for example. The result of brightness compensation will be reflected in the duty cycle signal DT. FIG. 6A is a diagram of offset error. FIG. 6B is a diagram of gain error. FIG. 6C is a diagram of LED brightness compensation according to embodiments of the invention.

As indicated in FIG. 6A, the offset error is the difference between the actual LED brightness and the predetermined LED brightness. The offset error makes the shift of the photo-electro conversion function. In FIG. 6A, the solid line denotes the predetermined LED brightness, the dotted line denotes the actual LED brightness, and symbol 610 denotes the offset error.

As indicated in FIG. 6B, the gain error refers to the maximum error between the maximum actual LED brightness and the predetermined LED brightness after the adjustment of the offset error. In FIG. 6B, the solid line denotes the predetermined LED brightness, the dotted line denotes LED actual brightness, and the symbol 620 denotes the gain error.

In the embodiments of the invention, the LED photo-electro conversion function is calibrated by way of measurement as indicated in FIG. 6C. The adjustable range of the LED is predetermined first, and then the current (or voltage) actually flowing through the LED and its corresponding LED light output are measured.

It is assumed that the ideal LED photo-electro conversion function be expressed as:

$$y_{ideal}=mx+b$$

After the LED brightness $y_{max}$ corresponding to the maximum voltage $x_{max}$ and the LED brightness $y_{min}$ corresponding to the minimum voltage $x_{min}$ within the adjustable range are obtained, the calibrated LED photo-electro conversion function is expressed as:

$$y_1=m_1x+b_1$$

The calculation of the parameters $m_1$ and $b_1$ are expressed as follows:

$$m_1 = \frac{y_{max} - y_{min}}{x_{max} - x_{min}}$$

$$b_1 = y_{min} - m_1 x_{min}$$

The comparison between the offset error 630 of FIG. 6C and the offset error 610 of FIG. 6A and the comparison between the gain error 640 of FIG. 6C and the gain error 620 of FIG. 6B show that the above method really compensates LED brightness.

It will be appreciated by those skilled in the art that changes could be made to the disclosed embodiments described above without departing from the broad inventive concept thereof. It is understood, therefore, that the disclosed embodiments are not limited to the particular examples disclosed, but is intended to cover modifications within the spirit and scope of the disclosed embodiments as defined by the claims that follow.

What is claimed is:

1. An LED control circuit in an image display apparatus or a lighting apparatus comprising a drive module and a plurality of LEDs, the LED control circuit comprising:

a memory, storing a plurality of duty cycle signals by memory mapping, wherein each duty cycle signal is related to each LED;

a memory control unit coupled to the memory, accessing the duty cycle signals stored in the memory;

a modulation unit coupled to the memory control unit, modulating the duty cycle signals accessed by the memory control unit into a plurality of first digital data, wherein the first digital data indicate ON/OFF state of the LEDs; and a data transmission module coupled to the modulation unit, receiving the first digital data in parallel, wherein the data transmission module converts the first digital data for serially outputting a plurality of second digital data;

wherein the drive module receives the second digital data to control ON/OFF of the LEDs.

2. The LED control circuit according to claim 1, further comprising:

a data latch array coupled to the memory control unit, temporarily storing the duty cycle signals accessed by the memory control unit and outputting the duty cycle signals to the modulation unit.

3. The LED control circuit according to claim 1, wherein the data transmission module comprises:

a data collector, receiving the first digital data outputted from the modulation unit and arranging as a third digital data, wherein the first digital data all comprise one single bit, and the third digital data comprise a plurality of bits; and a serial data transmission module coupled to the data collector, outputting the third digital data serial as the second digital data, wherein the second digital data each comprises one single bit.

4. The LED control circuit according to claim 2, wherein the memory serially receives the duty cycle signals; and the data latch array comprises a plurality of data latches temporarily storing the duty cycle signals respectively.

5. The LED control circuit according to claim 1, wherein the modulation unit comprises:

a counter, generating a counting value; and a comparator array comprising a plurality of comparators, wherein each comparator compares the counting value with each corresponding duty cycle signal to generate the first digital data.

6. The LED control circuit according to claim 3, wherein the serial data transmission module comprises:

a shift register, temporarily storing the third digital data, and outputting the third digital data bit by bit as the second digital data; and a serial data controller, controlling the shift register;

wherein the data controller further outputs a latch signal to the drive module to inform completion of transmission of the second digital data.

7. The LED control circuit according to claim 1, wherein the duty cycle signals are outputted from a microcontroller, the microcontroller performing an offset error compensation and a gain error compensation.

8. An image display apparatus, comprising:

a panel;

a plurality of LEDs, illuminating the panel;

a drive module, driving the LEDs; and an LED control circuit, comprising:

a memory, storing a plurality of duty cycle signals by memory mapping, wherein each duty cycle signal is related to each LED;

a memory control unit coupled to the memory, accessing the duty cycle signals stored in the memory;

a modulation unit coupled to the memory control unit, modulating the duty cycle signals accessed by the memory control unit into a plurality of first digital data, wherein the first digital data indicate ON/OFF of the LEDs; and a data transmission module coupled to the modulation unit, receiving the first digital data in parallel, wherein the data transmission module converts the first digital data for serially outputting a plurality of second digital data;

wherein the drive module receives the second digital data to control ON/OFF of the LEDs.

9. The image display apparatus according to claim 8, further comprising:

a data latch array coupled to the memory control unit, temporarily storing the duty cycle signals accessed by the memory control unit and outputting the duty cycle signals to the modulation unit.

10. The image display apparatus according to claim 8, wherein the data transmission module comprises:

a data collector, receiving the first digital data outputted from the modulation unit and arranging as a third digital data, wherein the first digital data all comprise one single bit, and the third digital data comprise a plurality of bits; and a serial data transmission module coupled to the data collector, outputting the third digital data serial as the second digital data, wherein the second digital data each comprises single bit.

11. The image display apparatus according to claim 9, wherein the memory serially receives the duty cycle signals; and the data latch array comprises a plurality of data latches temporarily storing the duty cycle signals respectively.

12. The image display apparatus according to claim 8, wherein the modulation unit comprises:

a counter, generating a counting value; and a comparator array comprising a plurality of comparators, wherein each comparator compares the counting value with each corresponding duty cycle signal to generate the first digital data.

13. The image display apparatus according to claim 10, wherein the serial data transmission module comprises:

a shift register, temporarily storing the third digital data and outputting the third digital data bit by bit as the second digital data; and a serial data controller, controlling the shift register, wherein the data controller further outputs a latch signal to the drive module to inform completion of data transmission.

14. The image display apparatus according to claim 8, wherein the duty cycle signals are outputted from a microcontroller, the microcontroller performing an offset error compensation and a gain error compensation.

15. A lighting apparatus, comprising:

a plurality of LEDs, emitting light;

a drive module, driving the LEDs; and an LED control circuit, comprising:

a memory, storing a plurality of duty cycle signals by memory mapping, wherein each duty cycle signal is related to each LED;

a memory control unit coupled to the memory, accessing the duty cycle signals stored in the memory;

a modulation unit coupled to the memory control unit, modulating the duty cycle signals accessed by the memory control unit into a plurality of first digital data, wherein the first digital data indicate ON/OFF of the LEDs; and a data transmission module coupled to the modulation unit, receiving the first digital data in parallel, wherein the data transmission module converts the first digital data for serially outputting a plurality of second digital data;

wherein the drive module receives the second digital data to control ON/OFF of the LEDs.

16. The lighting apparatus according to claim 15, further comprising:

a data latch array coupled to the memory control unit, temporarily storing the duty cycle signals accessed by the memory control unit and outputting the duty cycle signals to the modulation unit.

17. The lighting apparatus according to claim 15, wherein the data transmission module comprises:

a data collector, receiving the first digital data outputted from the modulation unit and arranging as a third digital data, wherein the first digital data all comprise one single bit, and the third digital data comprise a plurality of bits; and a serial data transmission module coupled to the data collector, outputting the third digital data serial as the second digital data, wherein the second digital data each comprises one single bit.

18. The lighting apparatus according to claim 16, wherein the memory serially receives the duty cycle signals; and the data latch array comprises a plurality of data latches temporarily storing the duty cycle signals respectively.

19. The lighting apparatus according to claim 15, wherein the modulation unit comprises:

a counter, generating a counting value; and a comparator array comprising a plurality of comparators, each comparator comparing the counting value with each corresponding duty cycle signal to generate the first digital data.

20. The lighting apparatus according to claim 17, wherein the serial data transmission module comprises:

a shift register, temporarily storing the third digital data and outputting the third digital data bit by bit as the second digital data; and a serial data controller, controlling the shift register, wherein the data controller further outputs a latch signal to the drive module to inform completion of data transmission.

21. The lighting apparatus according to claim 15, wherein the duty cycle signals are outputted from a microcontroller, the microcontroller performing an offset error compensation and a gain error compensation.

22. A method for controlling a plurality of LEDs, comprising:

serially receiving and temporarily storing a plurality of duty cycle signals;

modulating the duty cycle signals to generate a plurality of parallel first digital data, wherein the first digital data indicate ON/OFF of the LEDs;

converting a plurality of parallel first digital data into a plurality of second digital data and serially outputting the second digital data; and driving the LEDs according to the second digital data, to control light mixture in time-domain and brightness of the LEDs.

23. The control method according to claim 22, wherein the modulating step comprises:

generating a counting value; and comparing the counting value with one of the duty cycle signals to generate one of the first digital data.

24. The control method according to claim 22, wherein the converting step comprises:

arranging the first digital data into a third digital data;

outputting the third digital data serial into the second digital data, wherein the first digital data and the second digital data all comprise one single bit, and the third digital data comprise a plurality of bits.

25. The control method according to claim 22, wherein before the serially receiving step, the method further comprises:

performing an offset error compensation and a gain error compensation on the duty cycle signals.

* * * * *